US008122526B2

(12) United States Patent
Li

(10) Patent No.: US 8,122,526 B2
(45) Date of Patent: Feb. 28, 2012

(54) ADJUSTABLE UNIVERSAL FLAPPER

(75) Inventor: Feiyu Li, Xiamen (CN)

(73) Assignee: WDI International, Inc., Irvine, CA (US)

( * ) Notice: Subject to any disclaimer, the term of this patent is extended or adjusted under 35 U.S.C. 154(b) by 1002 days.

(21) Appl. No.: 12/060,668

(22) Filed: Apr. 1, 2008

(65) Prior Publication Data

US 2008/0244818 A1 Oct. 9, 2008

(51) Int. Cl.
*E03D 1/35* (2006.01)

(52) U.S. Cl. ..... 4/404; 4/393

(58) Field of Classification Search ..... 4/393, 403, 4/404, 392, 394, 385, 386, 387, 388, 378
See application file for complete search history.

(56) References Cited

U.S. PATENT DOCUMENTS

| | | | | |
|---|---|---|---|---|
| 4,419,773 | A * | 12/1983 | Sullivan | 4/392 |
| 5,390,375 | A * | 2/1995 | Fernstrum, Jr. | 4/404 |
| 5,966,749 | A * | 10/1999 | Goesling et al. | 4/392 |
| 6,173,457 | B1 * | 1/2001 | Higgins | 4/393 |
| 6,381,765 | B1 * | 5/2002 | Liu | 4/404 |
| 2003/0106144 | A1 * | 6/2003 | Kwen | 4/404 |
| 2003/0213054 | A1 * | 11/2003 | Huang | 4/395 |
| 2005/0283896 | A1 * | 12/2005 | Huang | 4/404 |
| 2006/0195977 | A1 * | 9/2006 | Shieh | 4/393 |
| 2006/0218713 | A1 * | 10/2006 | Chen et al. | 4/393 |
| 2009/0144888 | A1 * | 6/2009 | Han | 4/393 |
| 2010/0212080 | A1 * | 8/2010 | Huang | 4/393 |

* cited by examiner

*Primary Examiner* — David Purol
(74) *Attorney, Agent, or Firm* — Walter A. Hackler

(57) ABSTRACT

A toilet flush flapper valve includes a flapper and a ballast with a vent hole for enabling air to escape from the ballast, the ballast is rotatably fixed to the flapper for enabling positioning of the vent hole for controlling buoyancy of the ballast in order to control closing time of said flapper.

9 Claims, 2 Drawing Sheets

ADJUSTABLE UNIVERSAL FLAPPER

The present invention generally relates to flapper-type valve closures for toilet tanks and is more particularly directed to an adjustable time control flapper.

Typical prior art flappers are formed from an elastomer and have a hinge action and a flat sealing area surrounding a hollow buoyancy chamber.

The valves are operated by a chain and once open remain open until a liquid level in the tank drops to a level approximately that of the buoyant chamber. At that point, the valve drops with the falling water level until the sealing ring contacts the water tank outlet.

These valves are reliable and are useful, however, provide a minimal control over the volume of water dispensed from the tank.

In view of the fact that water is becoming a precious resource, it is desirable that as little as water is wasted during operation of the toilet.

A present invention enables the preselection of water dispensed during a toilet flush.

SUMMARY OF THE INVENTION

A toilet flush flapper valve in accordance with the present invention generally includes a flapper and a ballast having a vent hole for enabling air to escape the ballast. The ballast is rotationally fixed to the flapper which enables positioning of the vent hole which, in turn, controls the buoyancy of the ballast in order to control closing time of the flapper.

More particularly, the present invention includes a coupling member for rotatably fixing the ballast to the flapper. The coupling member includes a plurality of peripheral lugs for engaging the ballast and enabling stepwise rotation of the ballast with respect to the coupling member and flapper.

The flapper is provided with a hinge element extending therefrom which causes angular displacement of the ballast during water submersion of the ballast. In addition, the flapper may include a depending center shaft for attaching the coupling member thereto and a seal member is preferably disposed between the coupling member and a flapper and held against the flapper by the coupling member.

BRIEF DESCRIPTION OF THE DRAWINGS

The present invention may be more readily understood by consideration of the following detailed description when taken in conjunction with the accompanying drawings, in which.

DETAILED DESCRIPTION

Figure 1:
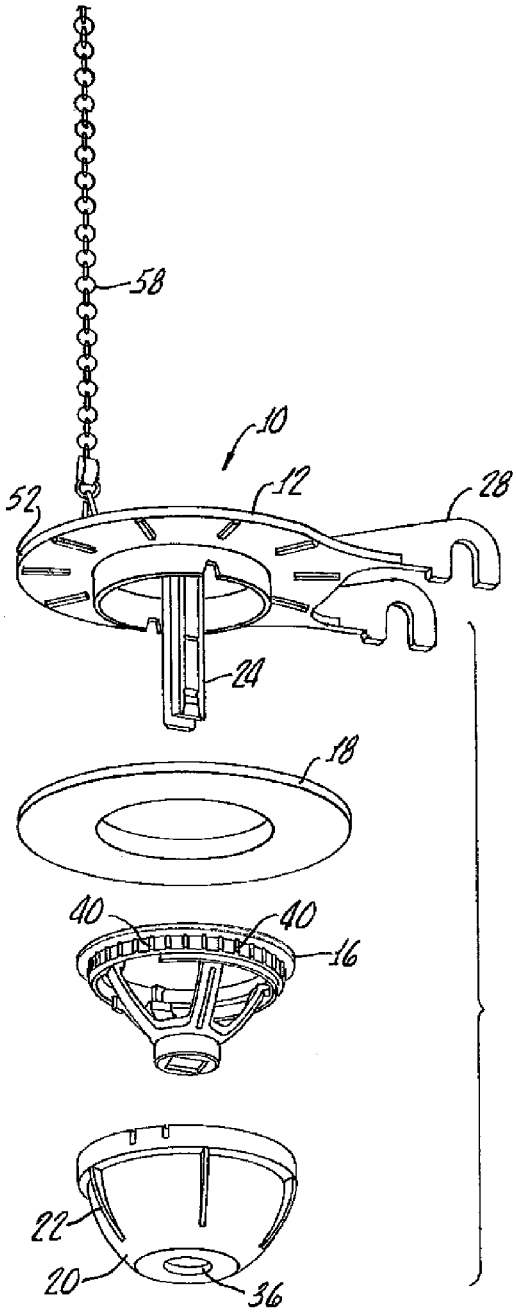
FIG. 1 is an exploded perspective view of a toilet flush flapper valve in accordance with the present invention generally showing a flapper, a seal member, coupling member, and a ballast.
Figure 2:
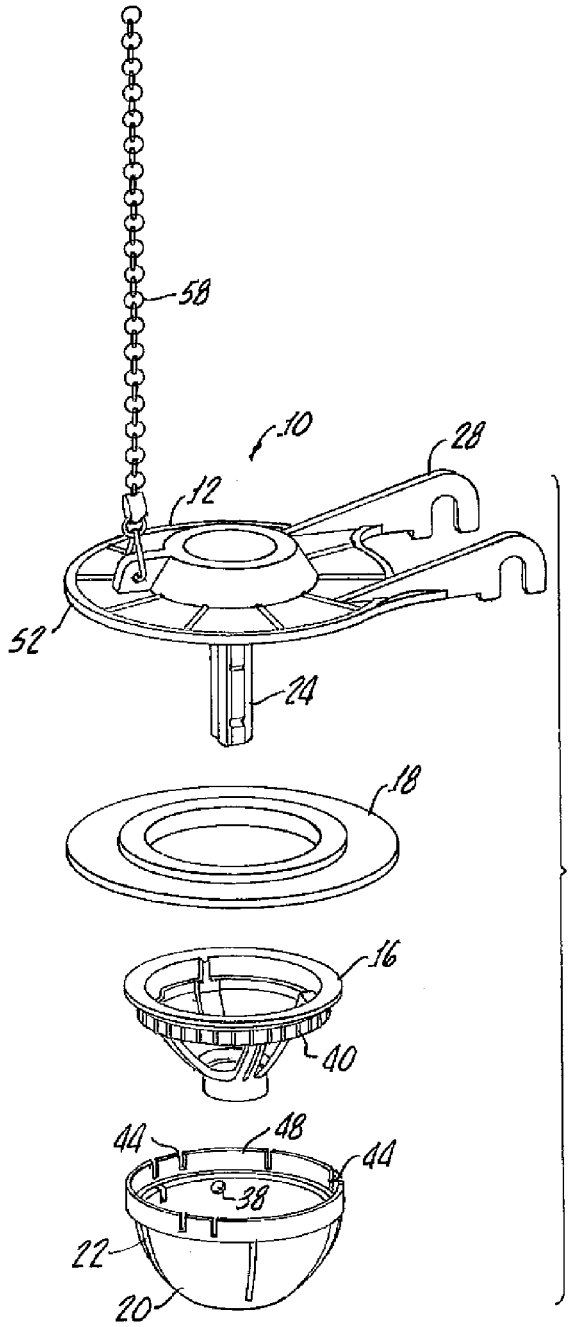
FIG. 2 is another perspective view of the present invention.

With reference to FIGS. 1 and 2, there is shown a toilet flush flapper valve 10 in accordance with the present invention which generally includes a flapper 12, a coupling member 16 for locking a silicone seal 18 against the flapper 12 and a ballast 20 with strengthening ribs 22.

Figure 3:
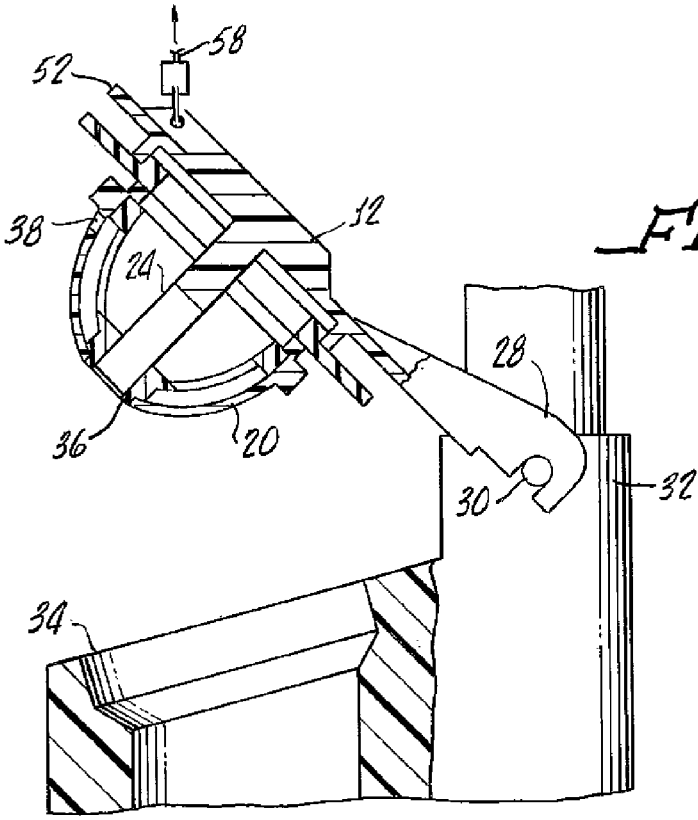
FIG. 3 is a side view illustrating operation of the valve with a ballast vent hole positioned for fastest closure.
Figure 4:
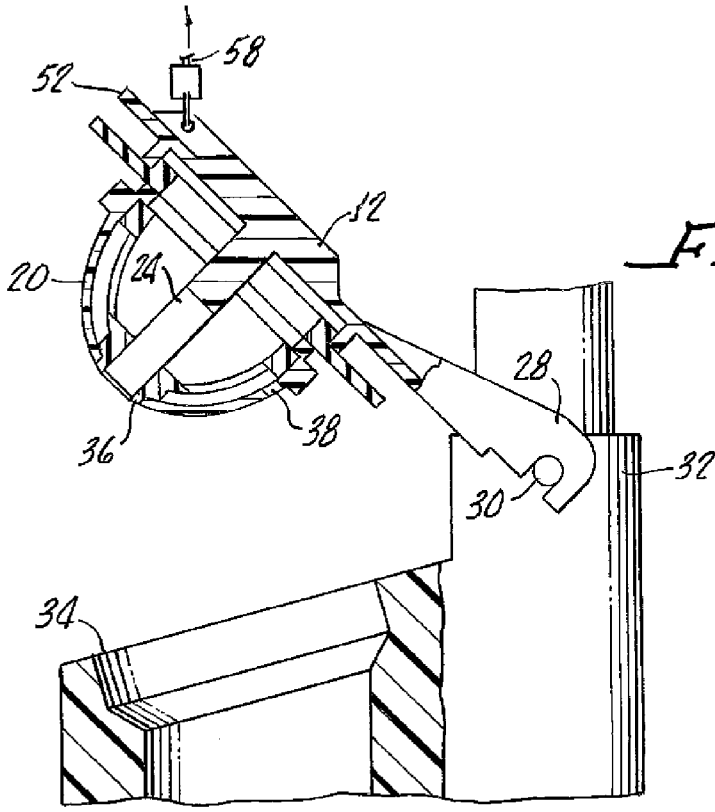
FIG. 4 is a side view illustrating operation of the valve with the ballast vent hole positioned for slowest closure.

The coupling member 16 rotatably fixes the ballast with respect to the flapper 12 and coupling member 16. The coupling member 16 is fixed to the flapper 12 by means of a depending center shaft 24. A hinge element 28, extending from the flapper 12 causes angular displacement of the ballast 20 upon submersion water as illustrated in FIGS. 3 and 4. This hinge element is preferred hinge 30 mounted to a toilet standpipe 32 enabling closure of the flapper in a valve seat 34 in a convention manner. A bottom opening 36 in the ballast 20 enables water flow therepast and a vent hole 38 enables air to escape from the ballast 20.

A plurality of peripheral lugs 40 on the coupling member 16 are provided for engaging slots 44 in the ballast 20 with rotation of the ballast 20 changing the location of the vent hole 38 located proximate a top 48 of the ballast 20. The vent hole 38 permits air to escape from the ballast 20 and this changes the overall buoyancy of the flapper 12 attached thereto. When vent hole 38 (which may be ¼ inch) is locked into a front most position as shown in FIG. 3 the flapper 12 closes faster. When the vent hole is locked into a rear most position as shown in FIG. 4, the flapper 12 closes slower. Thus, positioning the vent hole with respect to the flapper 12 permits the user to adjust the flapper 12 to work with a toilet to release a desired amount of water. A chain 58 attached proximate the flapper front 52 enables opening of the flapper 12 in a convention manner.

Although there has been hereinabove described a specific adjustable universal flapper in accordance with the present invention for the purpose of illustrating the manner in which the invention may be used to advantage, it should be appreciated that the invention is not limited thereto. That is, the present invention may suitably comprise, consist of, or consist essentially of the recited elements. Further, the invention illustratively disclosed herein suitably may be practiced in the absence of any element which is not specifically disclosed herein. Accordingly, any and all modifications, variations or equivalent arrangements which may occur to those skilled in the art, should be considered to be within the scope of the present invention as defined in the appended claims.

What is claimed is:

1. A toilet flush flapper valve comprising:

a flapper;

a ballast having a vent hole for enabling air to escape from the ballast, said ballast having slots and rotatably fixed to said flapper for enabling positioning of said vent hole for controlling buoyancy of said ballast in order to control closing time of said flapper;

a coupling member for rotatably fixing said ballast to said flapper; and a plurality of peripheral lugs on the coupling member for engaging the ballast slots in order to change location of the vent holes.

2. The valve according to claim 1 wherein said flapper includes a depending center shaft and said coupling member is attached thereto.

3. The valve according to claim 2 further comprising a seal member disposed between said coupling member and said flapper.

4. The valve according to claim 3 wherein said flapper includes a hinge element extending therefrom for causing angular displacement of said ballast.

5. A toilet flush flapper valve comprising:

a flapper;

a ballast having slots and a vent hole therein;

a coupling member for rotatably fixing said ballast to said flapper, rotation of said ballast enabling positioning of said vent hole for controlling buoyancy of said ballast in order to control closing time of the flapper upon submersion of said ballast in water;

a plurality of peripheral lugs on the coupling member for engaging the ballast slots in order to change location of the vent holes.

6. The valve according to claim 5 wherein said plurality of peripheral lugs for engaging said ballast slots are spaced apart for enabling stepwise rotation of said ballast with respect to said coupling member and said flapper.

7. The valve according to claim 6 wherein said flapper includes a depending center shaft and said coupling member is attached thereto.

8. The valve according to claim 7 further comprising a seal member disposed between said coupling member and said flapper.

9. The flapper according to claim 5 wherein said flapper includes a hinge element extending therefrom for causing angular displacement of said ballast during water submersion.

* * * * *